US005283390A

United States Patent [19]

Hubis et al.

[11] Patent Number: 5,283,390

[45] Date of Patent: Feb. 1, 1994

[54] TWISTED PAIR DATA BUS CABLE

[75] Inventors: Paul E. Hubis, Newark, Del.; Kim E. Ritchie, Elkton, Md.

[73] Assignee: W. L. Gore & Associates, Inc., Newark, Del.

[21] Appl. No.: 909,895

[22] Filed: Jul. 7, 1992

[51] Int. Cl.[5] ..... H01B 7/34

[52] U.S. Cl. ..... 174/36; 156/51; 174/34; 174/102 R; 174/113 R; 174/117 F

[58] Field of Search ..... 174/36, 32, 34, 117 F, 174/102 R, 113 R; 156/51

[56] References Cited

U.S. PATENT DOCUMENTS

| | | | |
|---|---|---|---|
| 1,654,074 | 12/1927 | Fondiller | 178/45 |
| 2,787,653 | 4/1957 | Ormerod | 174/117 R |
| 3,025,656 | 3/1962 | Cook | 174/34 X |
| 3,187,495 | 6/1965 | Christian, Jr. | 174/34 X |
| 3,320,350 | 5/1967 | Corrall et al. | 174/34 |
| 3,382,314 | 5/1968 | Nordblad | 174/34 |
| 3,448,569 | 6/1969 | Brown et al. | 57/15 |
| 4,041,237 | 8/1977 | Stine et al. | 174/36 |
| 4,096,346 | 6/1978 | Stine et al. | 174/36 |
| 4,697,051 | 9/1987 | Beggs et al. | 174/36 X |
| 4,860,343 | 8/1989 | Zetena, Jr. | 174/34 X |
| 5,015,800 | 5/1991 | Vaupotic et al. | 174/34 |
| 5,142,100 | 8/1992 | Vaupotic et al. | 174/24 |

FOREIGN PATENT DOCUMENTS

| | | | |
|---|---|---|---|
| 2637117 | 3/1990 | France | 174/36 |
| 8202627 | 1/1984 | Netherlands | 174/36 |
| 999545 | 7/1965 | United Kingdom | 174/36 |
| 9210841 | 6/1992 | World Int. Prop. O. . | |

*Primary Examiner*—Morris H. Nimmo
*Attorney, Agent, or Firm*—Gary A. Samuels

[57] ABSTRACT

A twisted pair data bus cable is provided which is small, lightweight and flexible.

The cable consists of a pair of insulated conductors twisted about one another, which has sections of the cable surrounded by metallic shielding, in which the sections surrounded by metallic shielding having a thicker insulation cross section than the sections not surrounded by metallic shielding.

2 Claims, 1 Drawing Sheet

TWISTED PAIR DATA BUS CABLE

FIELD OF THE INVENTION

This invention relates to electrical cables, and in particular to a twisted pair data bus cable that has areas of shielding and areas of non-shielding; and to a process for making the cable.

BACKGROUND OF THE INVENTION

In electrical systems where signals are transferred from one instrument to another, a data transfer wiring system known as a data bus wiring system may be used.

Those complex systems depend on electronic instruments to determine a condition or a set of conditions, and then transmit information or receive signals about the information over electronic wiring. Such a system is found in "fly-by-wire" aircraft systems where instruments detect various conditions of the aircraft and process the information to control the flight of the aircraft. To transfer the various signals from one instrument to another, a data bus wiring system is used.

A twisted pair of insulated conductors can be used as the data bus. However, while some areas along the length of the data bus must be unshielded so that "stub" cables to and from the instruments can be coupled to the bus, other areas along the bus must be shielded to prevent electrical signals from being radiated or from being subjected to outside noise. However, shielding causes a change in the size, weight, flexibility and electrical properties of the twisted pair data bus. For example, shielding lowers the impedance in that area of the cable and adversely affects performance of the system.

SUMMARY OF THE INVENTION

In this invention, a twisted pair cable data bus is provided which is small, lightweight, flexible and has substantially the same impedance in shielded areas as in unshielded areas.

More specifically, this invention is a continuous cable consisting of a pair of insulated conductors twisted about one another, which has sections of the cable surrounded by metallic shielding, in which the sections surrounded by metallic shielding having a thicker insulation cross section than the sections not surrounded by metallic shielding, the thickness of the thicker insulation being such that the impedance of the sections surrounded by metallic shielding is substantially the same as the section not surrounded by metallic shielding.

DETAILED DESCRIPTION OF THE INVENTION

Figure 1:
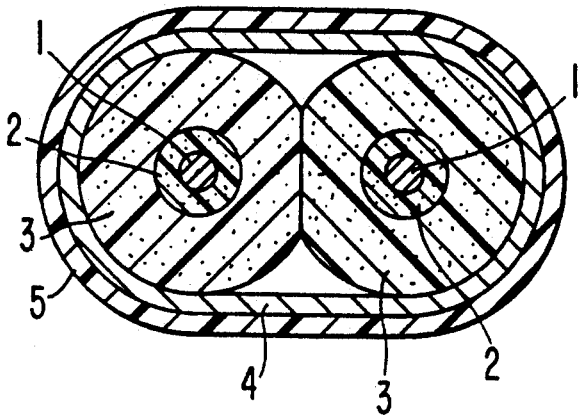
FIG. 1 depicts a cross section of a portion of the cable of the invention that contains shielding and added insulation.
Figure 2:
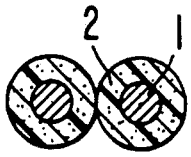
FIG. 2 depicts a cross section of the cable of the invention that has no shielding or extra insulation.

Referring to the drawings, a cross section of a cable of the invention containing a twisted pair of conductors is depicted in FIGS. 1 and 2. FIG. 1 depicts a cross section of a portion of the cable that is shielded. FIG. 2 depicts an unshielded cross section. In both Figures, the conductor wire 1 is surrounded by insulation 2 to form a primary insulated wire. As shown in FIG. 1, an additional layer or layers of insulation 3 are placed over insulation 2 at areas of the cable that will be shielded. Thus the cable will have areas of unequal diameter.

Figure 3:
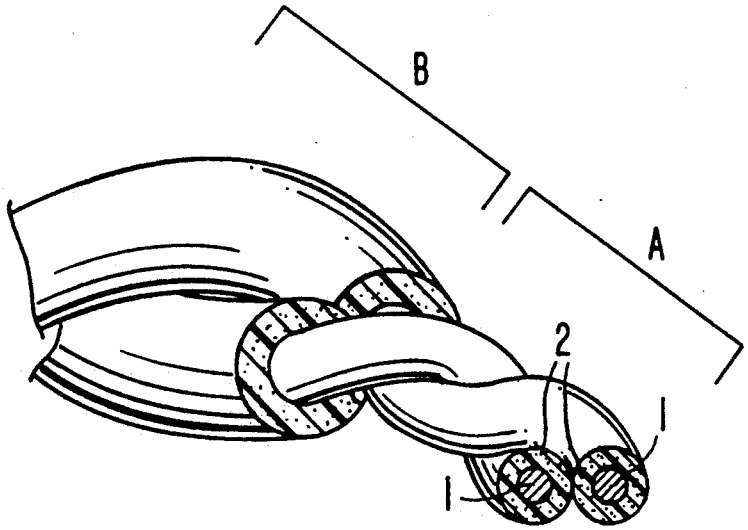
FIG. 3 depicts a perspective view of a twisted pair that has had extra insulation and shielding added in selected sections.

Then two such insulated conductors are twisted together in any conventional manner, taking care to ensure that sections of each insulated wire that have added insulation are matched and twisted together. This is shown in FIG. 3 where section A contains only wire 1 and insulation 2 and where section B's cross section is larger due to presence of added insulation. As shown in FIG. 1, the spacing between the insulated conductors of the pair may be less than the diameter of a single insulated conductor, due to possible densifying of the insulating at the area of contact between the insulated conductors as a result of having been twisted together.

Next, the twisted pair of primary insulated wires is bonded by heating until a bond is formed. Shielding 4 is then placed over the bonded twisted pair and is cut away from the areas that do not have added insulation.

Lastly a protective jacket 5 is placed over the shielded area.

The conductor wire 1 can be any electrical conductor, such as copper, silver or nickel plated copper, stainless steel, copper alloy, silver, nickel or beryllium copper.

Insulation 2 can be any insulation of low dielectric, but preferably is sintered expanded, porous polytetrafluoroethylene. Preferably, also it will be a tape that is helically wrapped around the conductive wire 1.

The additional layers of insulation 3 can be additional layers of expanded, porous polytetrafluoroethylene that may be strengthened by sintering or applying a skin of a fluorinated thermoplastic polymer, or both. Several layers of such varying tape constructions can be applied depending on the electrical properties desired.

The amount of thickness of extra insulation 3 that is added to selected sections of the cable is an amount necessary to maintain substantially the same impedance from shielded sections to unshielded sections. Thus the usual effect of lower impedance that is imparted by the shield is counteracted by using a greater thickness of insulation under the shield since added insulation increases the impedance. It is recognized that the extra amount used will depend both on the type of shielding and the dielectric of the insulation used.

The shielding 4 can be any metallic shielding, such as braided metal, served metal wire or served metal foil. An example of braided metal or served metal is silver plated copper. An example of a served foil is a foil of expanded, porous polytetrafluoroethylene containing a thin layer of aluminum. Preferably, the shielding 4 is braided tin-plated copper. The shielding can be applied by a braiding or serving machine.

The jacketing 5 can be any protective plastic layer such as, Teflon TPFE resin, or a thermoplastic fluoropolymer.

By this procedure, a continuous cable is obtained by "continuous" is meant that the cable is unspliced and unbroken.

In a typical cable assembly, the following characteristics of the cable were obtained:

| Characteristic | Unshielded | Shielded |
|---|---|---|
| Impedance | 130 ohms ±5% | <±2% change from unshielded impedance |

-continued

| Characteristic | Unshielded | Shielded |
|---|---|---|
| Velocity of Propagation | >78% | >77% |
| Attenuation | 6.1 dB/1000 feet | 6.6 dB/1000 feet |
| Primary Wire Diameter | 0.085 inch | 0.140 inch |
| Twisted Pair Diameter | 0.165 inch | 0.250 inch nominal |
| Overall Diameter | 0.165 inch | 0.290 inch nominal |
| Weight | 14.7 lbs./1000 feet | 47.0 lbs./1000 feet |
| Shield Coverage | | 85% |
| Stiffness (pounds of force to deflect a ten inch sample one inch on an instron machine) | | 2.2 pounds |

We claim:

1. A continuous electrical cable consisting of a pair of insulated conductors twisted about one another, which has sections of the cable surrounded by metallic shielding, and which has sections of the cable not surrounded by metallic shielding, in which the sections surrounded by metallic shielding have a thicker insulation cross-section than the sections not surrounded by metallic shielding, the thickness of the thicker insulation being such that the impedance of the sections surrounded by metallic shielding is substantially the same as the sections not surrounded by metallic shielding.

2. A process for preparing a continuous electrical cable consisting of a pair of insulated conductors twisted about one another, which has sections of the cable surrounded by metallic shielding, and which has sections of the cable not surrounded by metallic shielding, in which the sections surrounded by metallic shielding have a thicker insulation cross-section than the sections not surrounded by metallic shielding, the thickness of the thicker insulation being such that the impedance of the sections surrounded by metallic shielding is substantially the same as the sections not surrounded by metallic shielding, which comprises, in sequence:

(a) applying insulation to conductor wire;

(b) applying additional insulation to certain sections of the insulated conductor wire;

(c) twisting a first and second such insulated conductor wires around each other, such that the sections of additional insulation of the first insulated conductor wire are twisted with corresponding sections of additional of the second insulated conductor wire;

(d) applying metallic shielding over said first and second twisted insulated conductors at said certain sections of additional insulation; and (e) applying protective jacketing over said metallic shielding.

* * * * *